US005603608A

United States Patent [19]

Marz

[11] Patent Number: 5,603,608

[45] Date of Patent: Feb. 18, 1997

[54] METHODS AND APPARATUS FOR MONITORING PROGRESSIVE CAVITY PUMPS

[75] Inventor: Horst F. Marz, Otterburn Park, Canada

[73] Assignee: ICI Canada, Inc., North York, Canada

[21] Appl. No.: 424,993

[22] Filed: Apr. 19, 1995

[51] Int. Cl.[6] ..... F04B 49/10

[52] U.S. Cl. ..... 417/13; 417/32; 418/48; 277/2; 277/212 FB

[58] Field of Search ..... 417/13, 18, 32, 417/281, 53; 418/48, 153; 277/2, 28, 72 FM, 212 FB

[56] References Cited

U.S. PATENT DOCUMENTS

| | | | |
|---|---|---|---|
| 1,426,206 | 8/1922 | Lybeck . | |
| 2,512,765 | 6/1950 | Byram . | |
| 2,778,313 | 1/1957 | Hill . | |
| 3,064,454 | 11/1962 | Sharples . | |
| 3,111,904 | 11/1963 | Burns . | |
| 3,426,962 | 2/1969 | Shaw | 417/13 |
| 3,746,472 | 7/1973 | Rupp | 417/9 |
| 3,930,765 | 1/1976 | Waite . | |
| 4,500,268 | 2/1985 | Sundberg et al. . | |
| 4,599,056 | 7/1986 | Crase | 418/48 |
| 5,145,322 | 9/1992 | Senior, Jr. et al. | 417/13 |
| 5,261,676 | 11/1993 | Rockwood | 277/42 |
| 5,318,416 | 6/1994 | Hantschk et al. . | |

FOREIGN PATENT DOCUMENTS 255336 2/1988 European Pat. Off. .

OTHER PUBLICATIONS

*ICI Explosive Pump Code,* ICI International Inc., London, England, Jun. 16, 1992, pp. 13–16, 18–19, 37–46, and 57.

Netzsch Product Catalog entitled "The New NM Series—Who would have thought you could improve a NEMO® Pump?", Netzsch Mohnopumpen GmbH, Waldkraiburg, Germany, Jun. 1994.

Pumpen–Und Maschinenbau product brochure entitled "SEEPEX® Dry Running Protection TSE," Pumpen–und Maschinenbau Fritz Seebergerkg, Bottrop, Germany, Publication No. 700. date unk.

*Primary Examiner*—Timothy Thorpe
*Assistant Examiner*—Xuan M. Thai
*Attorney, Agent, or Firm*—Maurice M. Klee

[57] ABSTRACT

A system is providing for simultaneously addressing the problems of deadhead pumping, dry pumping, and seal failure in progressive cavity pumps. The system uses a hydraulic channel (23, 25, 26) which runs from the pump's rotor (5) to the pump's hydraulic motor (21) and includes the spaces defined by the seals (17) for the joints (8A, 8B) in the drive line for the rotor (5). At the rotor (5), the system includes a plug (19) which melts at a predetermined temperature. The hydraulic channel (23, 25, 26) is filled with lubricating oil and is pressurized. A drop in pressure either as a result of the melting of the plug (19) or a break in the integrity of the seals (17) is detected and used to stop the operation of the pump's motor (21). The system is resistant to disablement by operators.

28 Claims, 8 Drawing Sheets

METHODS AND APPARATUS FOR MONITORING PROGRESSIVE CAVITY PUMPS

BACKGROUND OF THE INVENTION

1. Field of the Invention

This invention relates to progressive cavity pumps and, in particular, to 1) methods and apparatus for monitoring the integrity of the lubrication systems used for the connecting shaft assemblies of such pumps and 2) methods and apparatus for improving the safety of such pumps under such conditions as deadhead operation, dry run operation, and lubrication system failure.

2. Description of the Prior Art

Progressive cavity pumps (pc-pumps) are widely used in the explosives industry because of their pulsation free flow, their low product shear, and their ability to handle products with up to 40% prills. They are also used in the food industry, in the handling of sewage, and in other applications where pumping of materials having relatively high abrasiveness is needed.

As shown in FIG. 1, a pc-pump 13 generally consists of a rotor 5 turning inside a stator 4. In a typical configuration, the rotor is geometrically a large pitched helix, while the stator can be regarded as a body with a two start helix with twice the pitch of the rotor. As a result, conveying spaces (cavities) are formed between the stator and the rotor.

During pumping, these cavities are filled with product and move continuously from the inlet 10 to outlet 11. As a result of the smooth transition from one cavity to the next, the pump delivery is almost pulsation free. The conveying spaces are sealed by the interference between the rotor and the stator. The latter is usually an elastomer 14 held within a rigid shell 15, although other configurations such as an elastomerically coated rotor can be used. The volume of the cavities during their advancement stays constant. The rotor moves radially within the stator. Other configurations besides a large pitched helix rotor in a two start helix stator can be used, including, for example, an elliptically shaped rotor in a tri-lobe stator. See, for example, Netzsch Product Catalog entitled "The New NM Series—Who would have thought you could improve a NEMO® Pump?", Netzsch Mohnopumpen GMBH, Waldkraiburg, Germany, June, 1994.

Rotor 5 is driven via drive shaft 6A and connecting shaft assembly 6B. Drive shaft 6A is connected to a suitable power source such as an electric, hydraulic, pneumatic, or other type of motor 72. To accommodate the orbital movement of rotor 5, connecting shaft assembly 6B either comprises a shaft made of a flexible material, such as, a spring steel, or comprises rigid shaft 6C provided with joints 8A and 8B at its ends as shown in FIG. 1. Such joints may, for example, be gear, pin, or universal joints.

Joints 8A and 8B are provided with seals or elastomeric boots 17 to prevent pumped material, e.g., explosives, from entering the joints. In some cases, rather than using two separate boots, an elastomeric sleeve is connected between the two joints and surrounds shaft 6C. Also, in certain configurations, a single boot can be used. See, for example, Waite, U.S. Pat. No. 3,930,765. Preferably, the joints are lubricated by a liquid, such as a lubricating oil. In such a case, the seals, boots, or sleeve, in addition to keeping pumped material out of the joints, also keep the lubricant out of the pumped material.

As shown in FIG. 1, drive shaft 6A is used to couple connecting shaft assembly 6B to the drive motor. If desired, connecting shaft assembly 6B can be connected directly to the output shaft of the motor. Also, multiple intermediate drive shafts can be used between the motor and the connecting shaft assembly. As used herein, the term "connecting shaft assembly" means the apparatus connected to the rotor (including any fixed extensions of the rotor which are considered part of the rotor), which apparatus allows the rotor to undergo orbital movement.

When pc-pumps work with explosives, they have to be guarded against excessive heat generation. During normal operation, pumped material carries heat away from the pc-pump, thus preventing the generation of excessive heat. Excessive heat, however, can be generated in cases of (1) deadhead operation and (2) dry pumping.

Deadhead operation (also known as deadhead pumping) occurs when flow from the pump is blocked. This can occur at the pump's outlet or downstream from the outlet. Deadhead pumping is potentially the most dangerous condition that can exist during the pumping of explosives. Assuming the drive motor does not stalls the total drive energy supplied to the pump is converted into heat, which is absorbed by the trapped explosives and by the rotor and the stator.

The rate of temperature rise depends on power input, heat sink capacity and heat dissipation of the system. When the decomposition temperature of the explosives is reached (e.g., a temperature above about 200° C. for emulsions), the entire plug of explosives within the pc-pump deflagrates, which generally results in pump destruction, physical damage to the surroundings, and serious injury to personal who may be in the vicinity of the pump.

Moreover, such a primary event may lead to secondary events if fragments from the pump provide sufficient shock impetus to detonate explosives in the vicinity of the pump. As a result of these considerations, deadhead pumping incidents are a serious concern to the explosives industry and much effort has been expended to try to reduce the probability of their occurrence.

Dry pumping occurs when a pc-pump is turning but no product is available on the suction side of the stator. When a pump runs in such a dry condition, it gains heat from friction and from work derived from the deformation of the elastomer of the stator. Since no product is available to carry the heat away, it has to be absorbed by the rotor, stator, and the thin film of explosives residue which remains within the stator. As the temperature increases, the stator expands mostly inwards because of its confining rigid outer shell. This, in turn, accelerates the heating and may result in ignition of the explosives residue in the pump.

Dry pumping is generally a lesser problem than deadhead pumping because there is less explosives in the pump, but the danger is still significant. Also, dry pumping tends to occur more often. For example, operators in dealing with an air-locked pump have been known to try to solve the problem by simply continuing to run the pump, rather than taking the time to prime the pump. Operators have also been known to disable conventional safety mechanisms to allow such unsafe procedures to be used. This unfortunate fact of life is one of the reasons that safety systems which are difficult to override are needed. As discussed below, the present invention provides such safety systems.

A third dangerous condition may occur when explosives enter the joints at the ends of the connecting shaft assembly as a result of a break in the integrity of the boot, seal, or sleeve which surrounds those joints. Although the sliding velocities in such joints are low, the contact pressure between the metallic parts is high and this can lead to increased friction especially when the lubricant is lost and replaced by explosives. Explosives are always sensitive to friction and can become even more so through crystallization and water loss. The friction levels in a joint can thus be high enough to ignite explosives. This constitutes a hazard.

When non-explosive materials are being pumped, the danger of an explosion, of course, does not exist. However, presence of pumped material in the joints is not desirable since it shortens the life of the pump and can lead to contamination of the pumped material by, for example, metal particles and the lubricant.

Numerous approaches have been used in the prior art to address the foregoing problems. These approaches have usually been electronic in nature and have sensed no flow, high and/or low pressure, or high temperature, all of which are indicators of unsafe conditions. Devices embodying these approaches have generally been sensitive and relatively delicate. Accordingly, they have worked well in a controlled environment, but have been less fail proof in a rough environment, such as on explosives pump trucks or underground explosives loading equipment. Another drawback is that these devices have generally been too easy to by-pass.

Examples of the prior art approaches include thermal dispersion flow sensors, Coriolis (U-tube) flow meters, pressure differential flow meters; devices for detecting absolute pressure levels, devices for monitoring supply levels of explosives to avoid dry pumping, pressure relief valves, thermofuses, bursting discs, and shut-off timers which must be reset before further pumping is permitted. Many of these devices are used in feedback loops to interrupt the supply of electrical or hydraulic power to the drive motor for the pump. See *ICI Explosive Pump Code,* ICI International Inc., London, England, Jun. 16, 1992, pages 13–16 and 37–46.

Along these lines, efforts have been made to measure the temperature between the rotor and the stator of a pc-pump using a thermistor sensor, and to then use the output of the sensor to control the operation of the pump's motor. See Pumpen-Und Maschinenbau product brochure entitled "SEEPEX® Dry Running Protection TSE," Pumpen-Und Maschinenbau Fritz Seebergerkg, Bottrop, Germany, Publication No. 700.

Also, efforts have been made to reduce the damage caused by a deflagrating pump, e.g., by using a stator which bursts at a preset internal pressure. See, for example, U.S. Pat. No. 5,318,416.

As discussed fully below, the present invention significantly improves on these prior safety approaches for pc-pumps. If desired, the present invention can be used in combination with one or more of these prior approaches, e.g., in combination with bursting discs or a stator which bursts at a preset internal pressure.

The integrity of boots 17 used to isolate joints 8A and 8B of connecting shaft assembly 6B has been tested in the past by 1) forming channels within drive shaft 6A and connecting shaft 6C and 2) equipping the drift shaft with a fitting for applying pressure to the drive shaft channel. The channels in the drive shaft and the connecting shaft communicated with the boots and thus boot integrity could be checked by applying pressurized air to the fitting and detecting the decline in pressure (if any) over time. This system suffered from a number of problems, including the fact that detection of boot integrity was not performed continuously and the fact that explosives entering a joint through a ruptured boot could block a channel so that the pressure test would indicate an intact boot, when in fact the boot was ruptured. See *ICI Explosive Pump Code,* ICI International Inc., London, England, Jun. 16, 1992, pages 18–19 and 57.

Examples from the patent literature of approaches which have been proposed to improve the safety of pc-pumps include Byram, U.S. Pat. No. 2,512,765, Hill, U.S. Pat. No. 2,778,313, and Marz, EPO Patent Publication No. 255,336.

SUMMARY OF THE INVENTION

In view of the foregoing, it is an object of this invention to improve the safety of pc-pumps.

More particularly, it is an object of the invention to provide methods and apparatus for addressing the deadhead, dry pumping, and joint seal integrity problems discussed above.

It is a further object of the invention, to provide such methods and apparatus which are highly resistant to disablement by operators.

It is an additional object of the invention to provide methods and apparatus for continuously monitoring the integrity of the sealing mechanisms used around one or more joints of a connecting shaft assembly of a pc-pump.

To achieve the foregoing and other objects, the invention in accordance with certain of its aspects provides a method for controlling a progressive cavity pump comprising:

(a) providing temperature sensing means (e.g., 19, 52, 54) for sensing the temperature of the pump's rotor (5), said means being carried by the rotor (5) and generating a signal (e.g., a hydraulic signal) when the temperature of the rotor (5) at the sensing means exceeds a predetermined temperature; and (b) applying the signal to the pump's means for rotating the rotor to stop said rotation when the temperature of the rotor at the temperature sensing means exceeds the predetermined temperature.

In accordance with others of its aspects, the invention further provides a method for controlling a progressive cavity pump which includes at least one joint (e.g., 8A, 8B) which is lubricated by a lubricant fluid, said method comprising:

(a) pressurizing the lubricant fluid;

(b) detecting a drop in the pressure of the lubricant fluid; and (c) stopping the rotation of the pump's rotor in response to the detected drop in pressure.

In accordance with other aspects of the invention, the above methods are performed concurrently. The invention also provides apparatus for practicing these methods.

Figure 1:
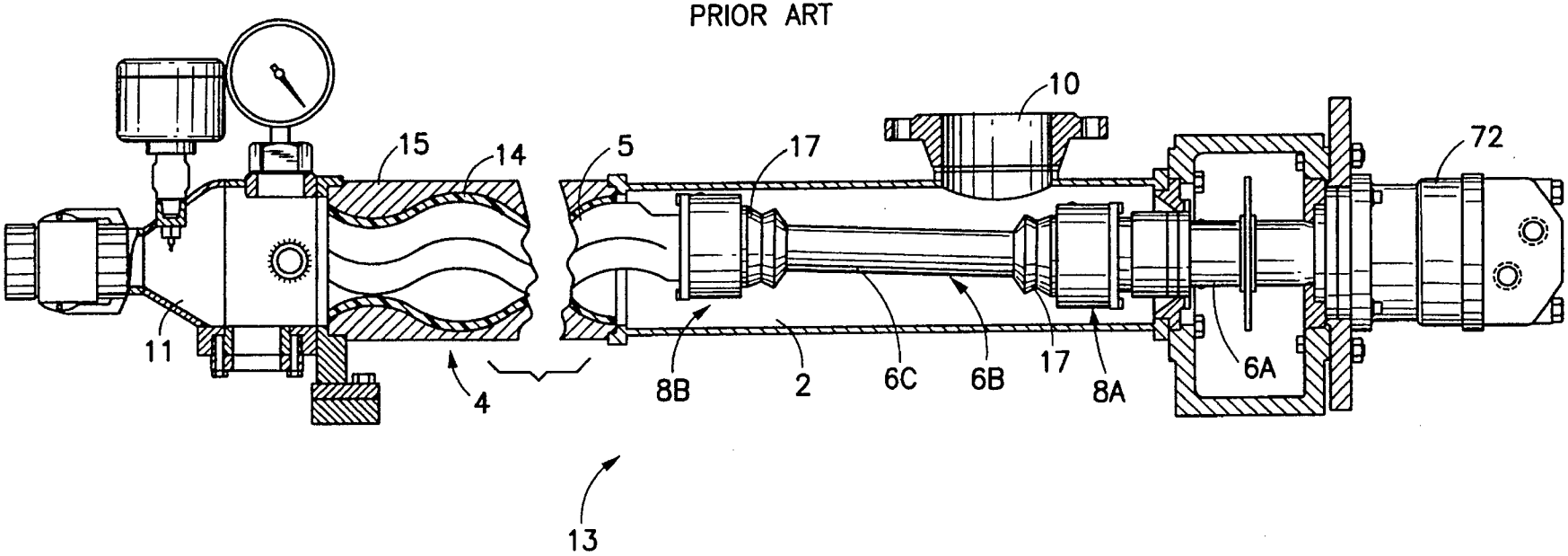
FIG. 1 PRIOR ART
FIG. 1 is a cross-sectional drawing of a prior art pc-pump.

The foregoing drawings, which are incorporated in and constitute part of the specification, illustrate various aspects of the invention, and together with the description, serve to explain the principles of the invention. It is to be understood, of course, that both the drawings and the description are explanatory only and are not restrictive of the invention. The drawings are not intended to indicate scale or relative proportions of the elements shown therein.

The reference numbers used in the drawings correspond to the following:

| | |
|---|---|
| 2 | suction chamber |
| 4 | stator |
| 5 | rotor |
| 6A | drive shaft |
| 6B | connecting shaft assembly |
| 6C | connecting shaft |
| 8A | joint |
| 8B | joint |
| 10 | pc pump inlet |
| 11 | pc pump outlet |
| 13 | pc pump |
| 14 | stator elastomer |
| 15 | stator shell |
| 17 | elastomeric boots |
| 19 | thermal plug |
| 21 | hydraulic motor |
| 23 | channel in rotor |
| 25 | channel in connecting shaft |
| 26 | motor shaft |
| 27 | channel in motor shaft |
| 29 | joint hub |
| 31 | oil reservoir |
| 33 | diaphragm |
| 35 | hydraulic valve assembly |
| 37 | high pressure supply line to hydraulic motor |
| 39 | low pressure return line from hydraulic motor |
| 41 | high pressure leg of bypass |
| 43 | low pressure leg of bypass |
| 45 | plunger |
| 47 | feed hole for lubricant oil |
| 49 | arrows illustrating lubricant oil flow |
| 50 | rupture in boot |
| 52 | vacuum chamber |
| 53 | flexible disc at end of vacuum chamber |
| 54 | sealing plug for vacuum chamber |
| 56 | chamber in rotor for vacuum chamber |
| 58 | plub body |
| 60 | plug core |
| 62 | O-ring |
| 64 | O-ring |
| 66 | shaft |
| 68 | gear |
| 70 | gear |
| 71 | motor shaft |
| 72 | motor |
| 74 | central channel |
| 76 | detector |

Also in FIGS. 2–6, the letters "P" and "T" are used to designate the pressure line and tank line, respectively, leading to and from hydraulic motor 21.

DESCRIPTION OF THE PREFERRED EMBODIMENTS

As discussed above, the present invention relates to an improved pc-pump.

Figure 2:
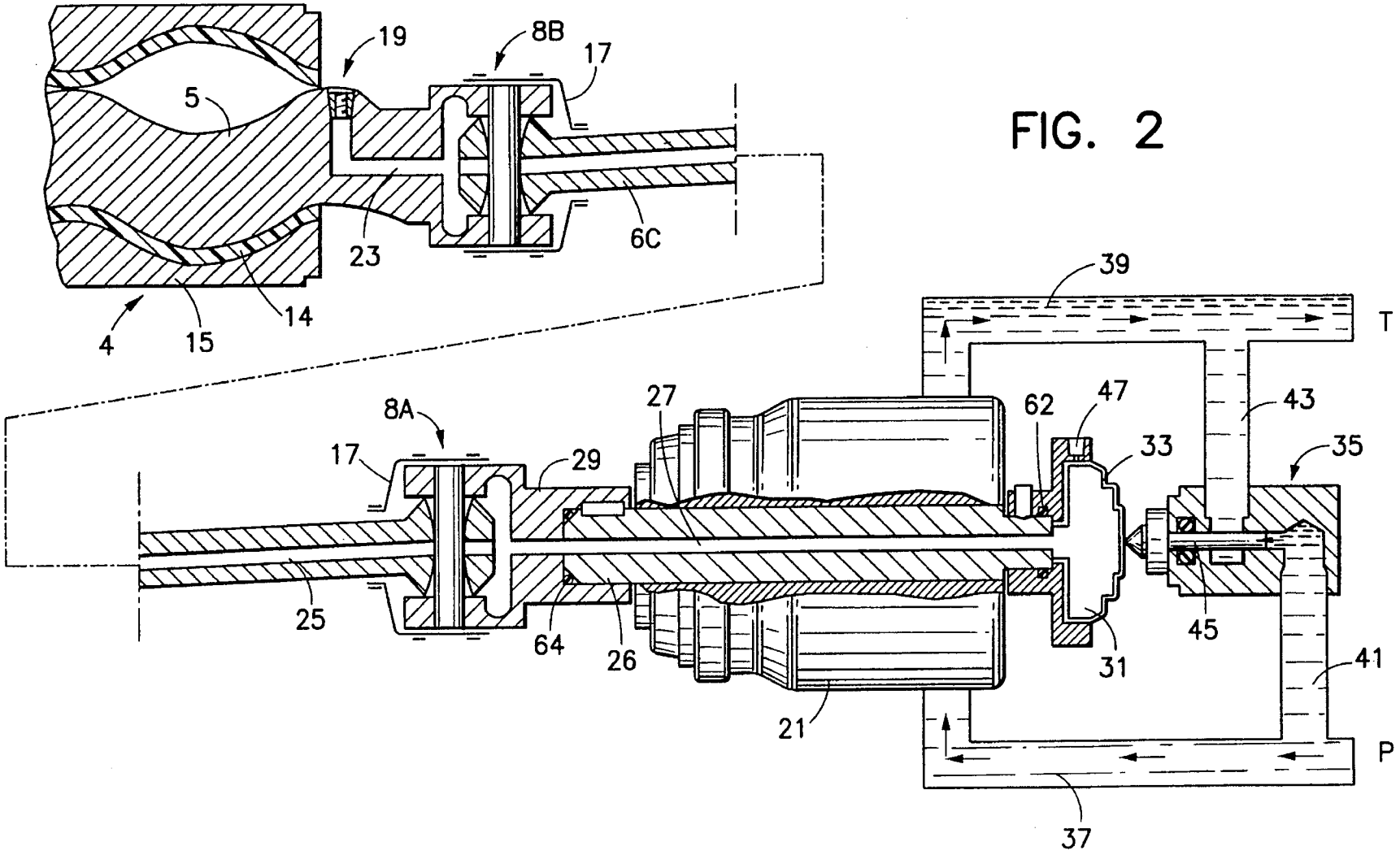
FIG. 2 is a schematic drawing of an embodiment of the present invention employing a melting plug. This figure shows the system in its normal condition.
Figure 3:
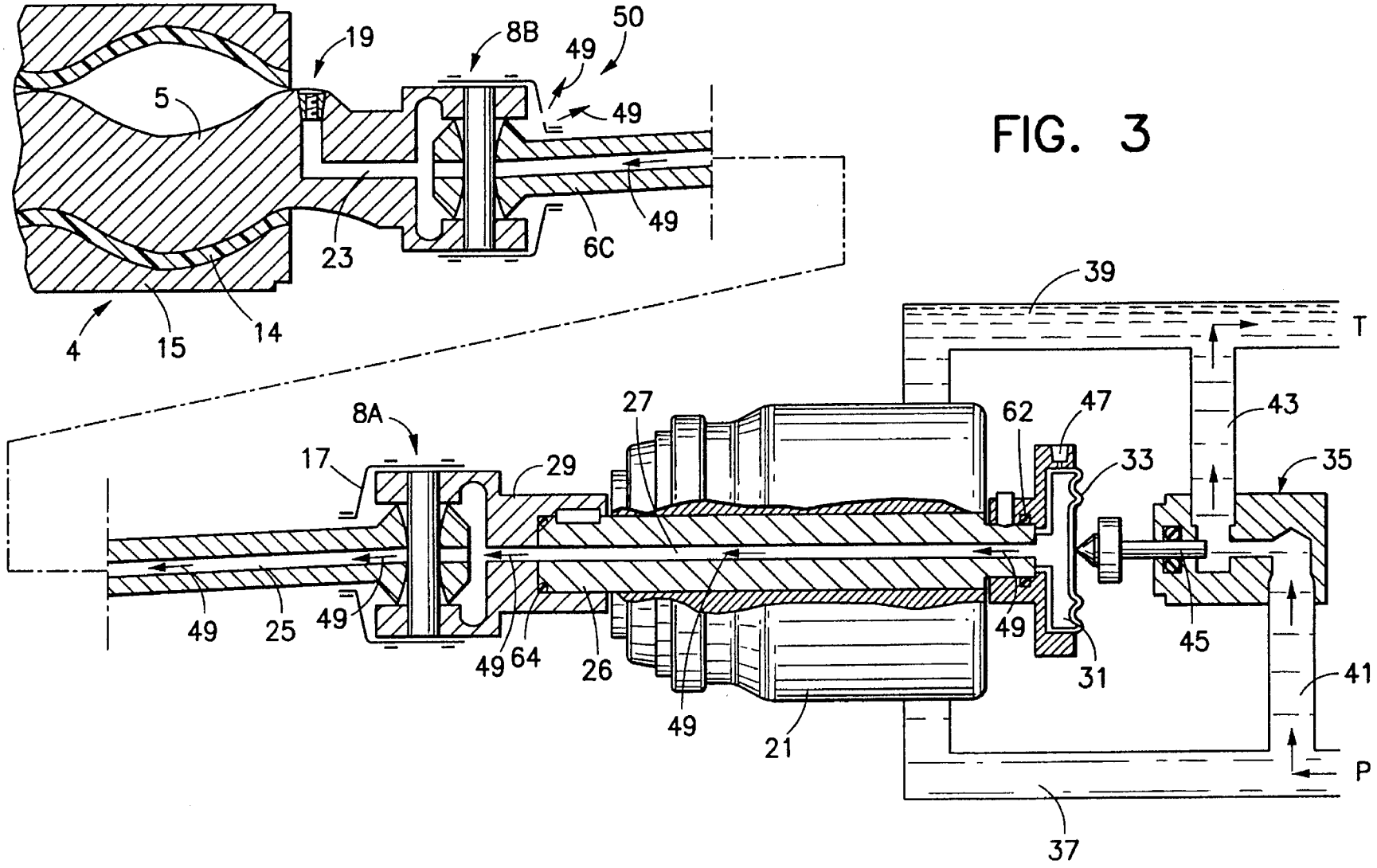
FIG. 3 is a schematic drawing of the system of FIG. 2 under the condition of failure of a joint seal.
Figure 4:
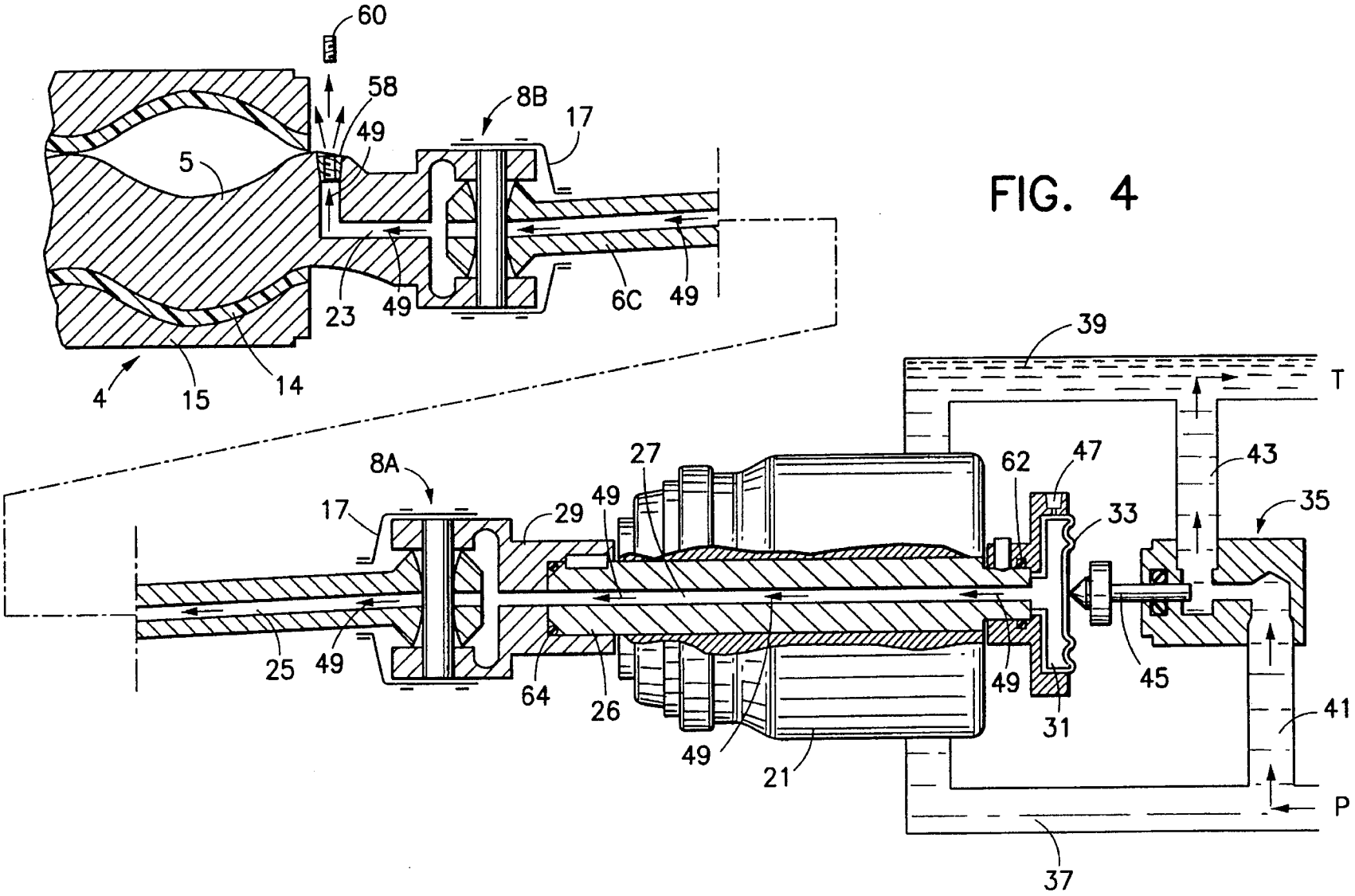
FIG. 4 is a schematic drawing of the system of FIG. 2 under the condition of excessive rotor temperature.

FIGS. 2–4 schematically show a preferred embodiment of the invention for use with a pc-pump driven by a hydraulic motor 21. FIG. 2 shows the system in its normal configuration; FIG. 3 shows the response of the system to a boot (seal) failure; and FIG. 4 shows the response of the system to an overheat condition, e.g., a deadhead or dry pumping situation.

Motor shaft 26 extends through hydraulic motor 21 and is driven by high pressure hydraulic fluid which enters the motor through high pressure supply line 37 and leaves the motor through low pressure return line 39.

Shaft 26 is connected directly to joint 8A via hub 29. Shaft 26 includes central channel 27 which communicates with reservoir 31 and the interior of sealed joint 8A. Joint 8A is connected to joint 8B by connecting shaft 6C. Shaft 6C includes central channel 25 which communicates with the interior of sealed joint 8A and with the interior of sealed joint 8B. Sealed joint 8B is connected to rotor 5. Channel 23 is formed in rotor 5 and communicates at one end with the interior of sealed joint 8B. At its other end, channel 23 has a plug 19 composed of a material which melts at a predetermined temperature. Channels 23, 25, and 27 can have diameter of about 6–8 millimeters, although other diameters can be used if desired.

The predetermined melting temperature for plug 19 is chosen based on the material which is to be pumped. For example, for explosives, the temperature is chosen based on the explosives' maximum pumping temperature. In general, the predetermined melting temperature is about 20° C. to about 40° C. above the maximum pumping temperature, but well below the temperature where decomposition of the explosives can occur. The maximum pumping temperature for non-cap sensitive explosives is generally around 80° C., while for cap sensitive explosives, the maximum pumping temperature is about 95° C. Preferred predetermined melting temperatures for plug 19 are thus about 100° C. for non-cap sensitive explosives and about 125° C. for cap-sensitive explosives. The about 100° C. and about 125° C. values can be achieved using various eutectic or near eutectic alloys known in the art, e.g., 26% Sn, 21% Cd, and 53% Bi to achieve a 103° C. melting temperature and 56% Bi and 44% Pb to achieve a 124° C. melting temperature. Other alloys, as well as other materials having defined melting temperatures, can also be used if desired.

Reservoir 31, sealed joints 8A and 8B, and channels 23, 25, and 27 form a continuous sealed system (the "sealed lubricant system"). Sealing is achieved through the use of static seals which have zero leakage at both ends of the hydraulic motor in combination with boots 17 which seal joints 8A and 8B. As shown in the figures, the static seals can be O-rings 62 and 64. As discussed above, instead of boots 17, other sealing means with zero leakage when intact can be used to seal off the joints, e.g., a sleeve or hose which extends between the joints and surrounds connecting shaft 6C. It should be noted that when such a sleeve or hose is employed, central channel 25 can be eliminated if desired.

Figure 8A:
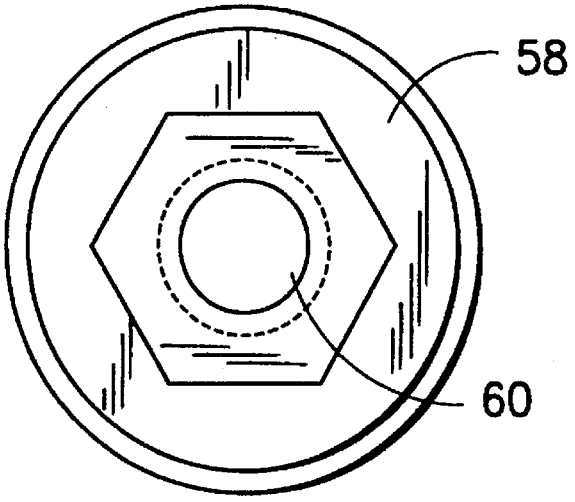
FIGS. 8A and 8B are a top plan view and a cross-sectional view, respectively, of a heat plug for use with the present invention.
Figure 8B:
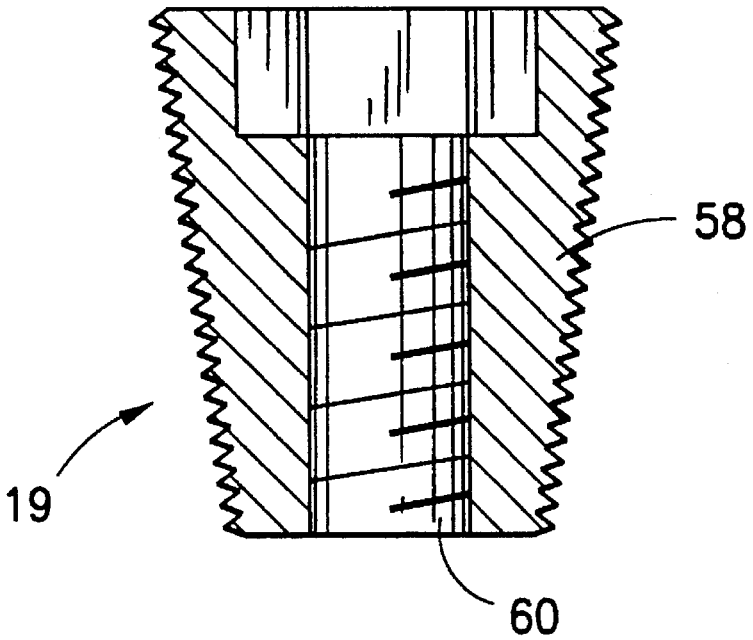

The sealed lubricant system is filled with a joint lubricant, such as oil, through feed hole 47. To remove air from the system, plug 19 is loosened and then retightened once bubble free oil is seen exiting around the plug. A preferred construction for plug 19 which facilities these operations is discussed below in connection with FIGS. 8A and 8B.

The sealed lubricant system is pressurized by using a pressurized source of joint lubricant and by closing off feed hole 47 while pressure is being applied from said source. In some cases, it may be desirable to evacuate the system before filling it with the joint lubricant so as to minimize the presence of air pockets around, for example, boots 17.

The initial pressure within the system is chosen to be greater than the expected head pressured within suction chamber 2 (see FIG. 1). In this way, if a boot 17 ruptures, fluid will exit the boot, rather than emulsion entering the boot. Similarly, fluid will exit from plug 19 upon its melting under deadhead conditions (see discussion below). The initial pressure must be less than the pressure rating of boots 17 or other sealing mechanism of joints 8A and 8B. In the case of boots, a preferred initial pressure is between about 2 bar and about 4 bar, e.g., about 3 bar, which is well within the range of pressures which commercially available boots can withstand. Higher or lower pressures, e.g., pressures in the range from about 0.2 bar to about 6.0 bar, can, of course, be used if desired, depending upon the specifics of the construction of the joints and their sealing mechanism.

In addition to its initial pressurization during filling, pressure is also applied to the system through diaphragm 33 which forms one end of reservoir 31. Specifically, the high pressure hydraulic fluid in high pressure supply line 37 is used to drive plunger 45 of hydraulic valve assembly 35 towards diaphragm 33. The front (leading) end of plunger 45 preferably is in the form of a cone-shaped, freely rotating bearing so as not to apply substantial torque to either diaphragm 33 or plunger 45 as motor shaft 26 rotates.

Preferably, the ratio of the cross-sectional area of the plunger to the cross-sectional area of the diaphragm is chosen so that when high pressure hydraulic fluid is supplied to supply line 37, the pressure applied to the diaphragm through the cone-shaped bearing is approximately equal to the initial pressure in the system. In this way, during use, the diaphragm is under essentially no net force. As discussed above, the initial pressure in the system is preferably greater than the expected head pressure in suction chamber 2. By making the pressure applied to diaphragm 33 approximately equal to this initial pressure, upon rupture of a boot or the melting of plug 19, the pressure supplied to the system by the plunger will also be greater than the expected head pressure.

As shown in FIGS. 2–4, hydraulic valve assembly 35 is mounted directly on the back of hydraulic motor 21. In some cases, it my be more convenient to integrate the assembly with the motor's existing hydraulic control valving and to use a mechanical linkage to transmit force from the assembly to diaphragm 33. Such hydraulic control valving can, for example, be located above motor 21 in FIGS. 2–4, and a lever type linkage can be used to transfer force to diaphragm 33 and to sense movement of the diaphragm as a result of a loss of pressure within the sealed lubricant system.

Diaphragm 33 can be made of, for example, stainless steel and can be in the form of, for example, a series of concentric ridges to provide the desired level of flexibility.

FIG. 3 shows the response of the system to a boot failure. The boot failure is schematically represented by reference number 50 and the flow of lubricant fluid to and through the ruptured boot is represented by arrows 49. As can be seen in FIG. 3, because the fluid is pressurized to a pressure greater than the expected head pressure in suction chamber 2, lubricant fluid flows through the system to the failure location and exits from the system at that location. This causes diaphragm 33 to move to the left in the figure in response to the pressure applied to the diaphragm by plunger 45. The movement of plunger 45, in turn, causes high pressure bypass leg 41 to be connected to low pressure bypass leg 43, thus shutting off hydraulic motor 21. In this way, a boot rupture automatically prevents further operation of the pc-pump.

It should be noted that since the shut-off mechanism is an integral part of the hydraulic motor, improper disablement of this safety system is less likely by operators. To further inhibit such activity, reservoir 31, diaphragm 33, and hydraulic valve assembly 35 can be enclosed in a housing rigidly fastened to the hydraulic motor and that housing can be permanently sealed or secured by a locking mechanism which is accessible only to supervisory personnel.

FIG. 4 shows the operation of the system during an overheat situation. Plug 19 melts at its predetermined temperature, thus allowing the lubricant fluid to exit the system. The system then operates in the same manner as in FIG. 3 to shut off hydraulic motor 21.

Figure 5:
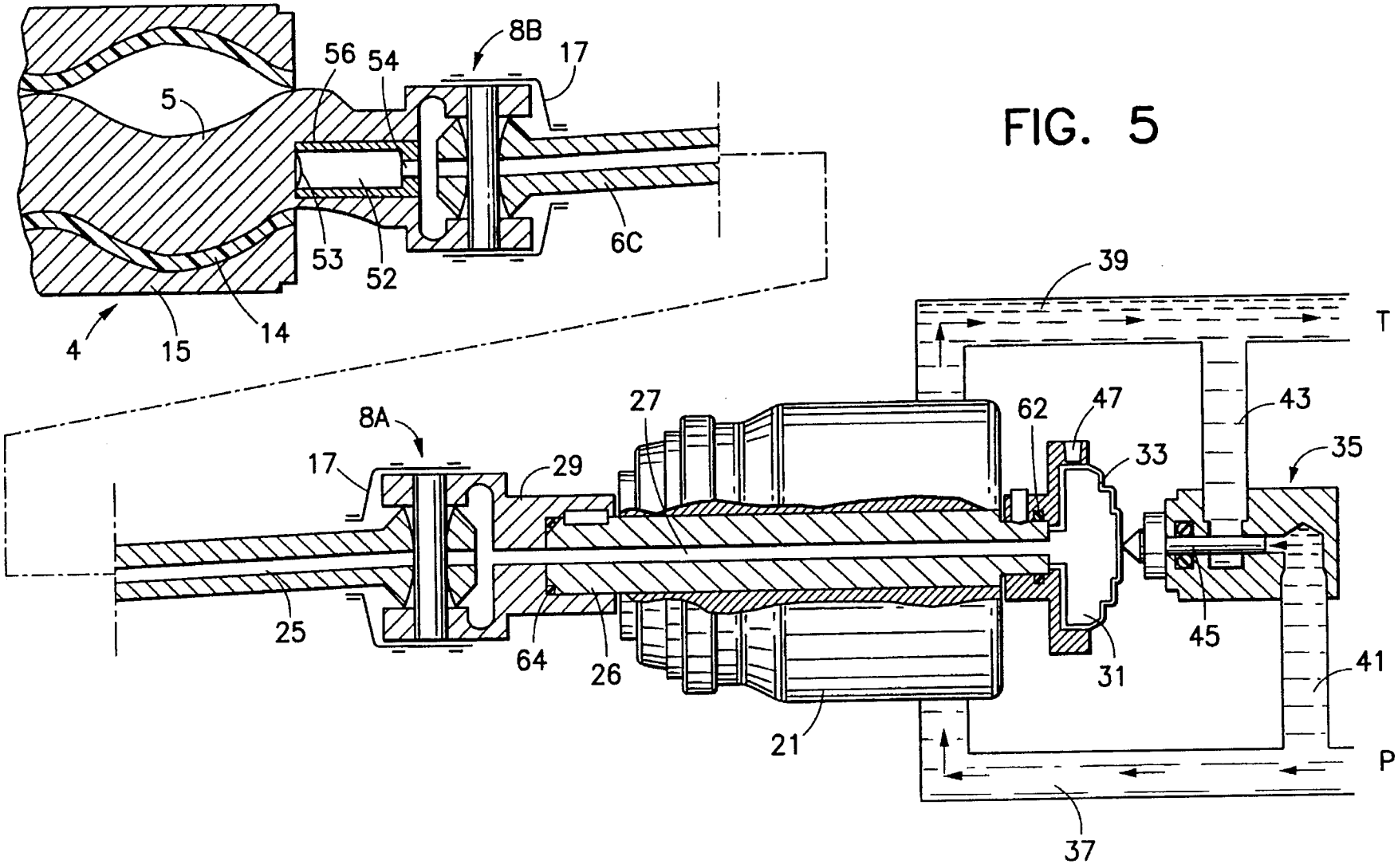
FIG. 5 is a schematic drawing of a embodiment of the present invention employing a vacuum chamber having a melting plug. This figure shows the system in its normal condition.
Figure 6:
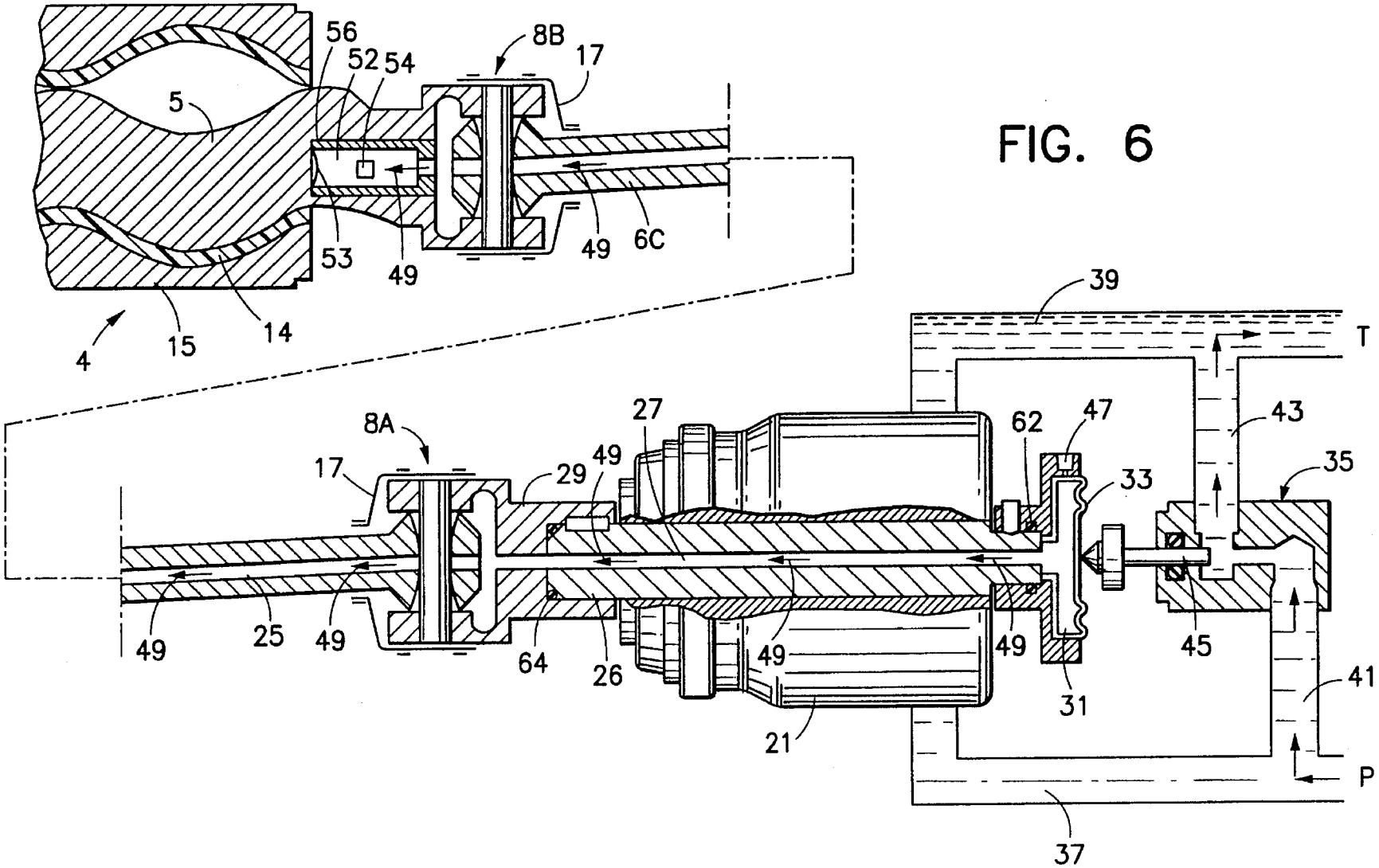
FIG. 6 is a schematic drawing of the system of FIG. 5 under the condition of excessive rotor temperature.

FIGS. 5 and 6 show an alternative to the use of plug 19. This construction employs a vacuum chamber 52 which is received in chamber 56 formed in the end of rotor 5.

Vacuum chamber 52 is sealed by sealing plug 54 which can be made of the same types of material as used for plug 19. Melting of plug 54 due to excess heat in rotor 5 caused by a deadhead or dry pumping situation allows lubricant fluid to enter the vacuum chamber. The operation of the system then follows the same pattern as discussed above with regard to FIG. 4. Boot failure for this embodiment operates in the same manner as shown in FIG. 3 for the plug embodiment.

Vacuum chamber 52 should be sized to be large enough to allow diaphragm 33 to move far enough to the left in FIG. 6 so that plunger 45 opens the bypass between the high and low pressure sides of the hydraulic system. For the system of FIGS. 5–6, an additional port (not shown) is preferably provided which is connected to, for example, chamber 56 to allow for bleeding of air from the lubricant fluid.

Vacuum chamber 52 can be equipped with a flexible disc 53 which provides a convenient monitor for the presence of vacuum within the chamber. Specifically, when the disc is concave inward, vacuum is present, whereas when the disc is flat, vacuum is absent.

The use of a vacuum chamber can allow for lower pressure values within the sealed lubricant system since during an overheat condition, specifically, a deadhead condition, the lubricant does not have to overcome the head pressure within suction chamber 2. To detect boot failure, the lubricant does enter suction chamber 2. If boot failure occurs during normal operation or during dry pumping, the pressure within suction chamber 2 is either low or negative (normal operation) or zero (dry pumping). If boot failure occurs during a deadhead condition, head pressure in suction chamber 2 can be high, but the deadhead condition will cause the vacuum chamber to operate through melting of plug 54 so that the power source for the pump will be disabled in any event.

The embodiments of FIGS. 2–6 do not include a drive shaft 6A as shown in FIG. 1. Such a shaft can be used if desired. In such a case, a channel will be formed in the drive shaft and static seals will be formed between the drive shaft and the motor shaft and the joint 8A.

Figure 7:
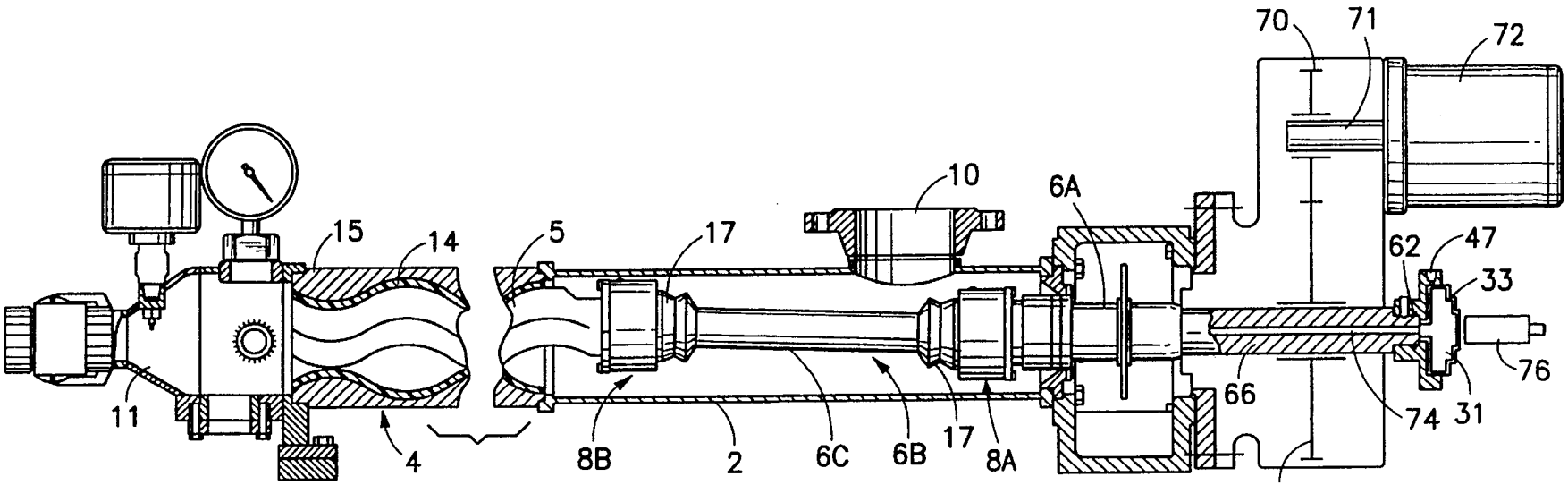
FIG. 7 is a schematic drawing of an alternate mechanism for driving the pump's rotor using a gear train. It also illustrates and alternate control system for the pump's motor.

FIG. 7 shows an alternate construction in which the pump's motor operates through a gear box. Specifically, as shown in this figure, a gear 68 is mounted on shaft 66 and a second gear 70 is mounted on the output shaft 71 of motor 72 to transfer power from the motor to shaft 66 and hence to the pump. Motor 72 may be a hydraulic motor as in FIGS. 2–6 or an electric or pneumatic motor.

Shaft 66 includes central channel 74 which communicates with central channels in drive shaft 6A and connecting shaft 6C (not shown in FIG. 7), as well as with sealed joints 8A and 8B. Rotor 5 is equipped with a temperature sensitive, pressure relief mechanism (not shown), such as the melting plug mechanism of FIGS. 2–4 or the melting plug/vacuum chamber mechanism of FIGS. 5–6. As shown in FIG. 7, reservoir 31 and diaphragm 33 are mounted at the right hand end of shaft 66. O-ring 62 forms a static seal between the shaft and the reservoir.

Loss of liquid lubricant from the sealed system is detected by movement of diaphragm 33. A generic detector is shown at 76 in FIG. 7. This detector may be an electronic or pneumatic proximity detector, an electronic, hydraulic, or pneumatic limit switch directly connected to the diaphragm, or similar devices capable of responding to the movement of the diaphragm. The output of the detector is used to control the operation of motor 72.

It should be noted that the motor control system of FIGS. 2–6 (e.g., hydraulic valve assembly 35) can be used with the embodiment of FIG. 7 when motor 72 is a hydraulic motor. Similarly, the motor control system of FIG. 7 employing generic detector 76 can be used with the systems of FIGS. 2–6 if desired.

A preferred construction for plug 19 is shown in FIG. 8. The plug includes a body 58 and a core 60 made of the meltable material. The body has a tapered thread on its outside surface for engagement with rotor 5. This thread is preferably self-sealing. To avoid tampering with the safety system of the invention, a non-standard thread can be used for the outside of the plug's body. The use of a threaded plug facilitates the replacement of plugs which have undergone melting during the protection of a pump from an overheat event.

The body of the plug also has a parallel thread on its inside surface for engagement with a corresponding thread on the outside surface of core 60. This provides greater purchase between the core and the body. Body 58 also can include a recess at its upper end for receiving a key for tightening the plug into the rotor. The recess can be a standard hexagon of the Allen wrench type. A non-standard recess can also be used to further minimize the chances of tampering with the safety system.

The construction shown in FIG. 8 for plug 19 can also be used for plug 54 used to seal vacuum chamber 52 in the embodiment of FIGS. 5 and 6.

Since the operation of plug 19 and vacuum chamber 52 depends upon transfer of heat to the material which is to melt, it is important that rotor 5 have a sufficiently high thermal conductivity so that the system has an overall fast response time to deadhead or dry pumping situations. Stainless rotors generally have a sufficient conductivity, although other materials having higher conductivity can be used if desired. Also, the plug or vacuum chamber should be placed as close as possible to the stator inlet so as to minimize the distances over which heat has to travel from its point of generation within the rotor/stator assembly to the plug or vacuum chamber. Further, rotor 5 can be equipped with an internal heat pipe to aid in the transfer of heat from remote parts of the rotor to the plug or vacuum chamber.

From the foregoing, it can be seen that the present invention has, among others, the following advantages:

(1) In comparison to the prior art, the invention is able to check deadhead, dry pumping and seal integrity using a single system.

(2) The system trips reliably during deadhead and dry pumping at a predictable temperature because the trip is initiated by a low temperature eutectic alloy which has a sharp melting point and is placed in the hottest part of the pump, the rotor.

(3) The invention permits continuous checking of the joint boots. Should a leak develop, it is sensed immediately and the pump is stopped shortly thereafter. The prior art at best permitted the checking of the joint boots and other seals by periodic pressurization. Such periodic inspection is time consuming and leaves the pump unprotected against boot failures between inspections.

(4) In comparison to the prior art, the system of the present invention is more direct acting (less signal transformations) and has therefore a lower failure frequency rate.

(5) The system is not susceptible to having its set point altered by operators as in the case of electrically based systems. Variation in set point can be achieved by using materials which melt at different temperatures. Operators, however, will not generally have such materials available or the means to fabricate them into a plug or similar structure.

Although specific embodiments of the invention have been described and illustrated, it is to be understood that modifications can be made without departing from the invention's spirit and scope. For example, although the system has been illustrated in terms of detecting both failure of the joint lubrication containment system and overheat conditions in the rotor/stator assembly, the invention can also be practiced for just one of these events.

For example, for a connecting shaft assembly which does not employ joints, e.g., an assembly using a flexible connecting shaft, the heat detection aspects of the invention can be practiced by forming a central channel in the flexible shaft or surrounding the shaft with a flexible shell, and using that channel or shell to connect temperature responsive means at the rotor with control means for the pump's power source. Similarly, for a product which is not heat sensitive, but needs to be kept free of contamination from joint lubricant, the seal failure aspects of the invention can be practiced without using the overheat detection aspects. It should be noted, however, that even for materials that are not heat sensitive, the rotor/stator assembly is itself heat sensitive especially when run dry, and thus the overheat detection aspects of the invention are preferably employed even when the material being pumped is not itself heat sensitive.

Various constructions other than those illustrated in the figures can be used in the practice of the invention. For example, instead of using a flexible diaphragm 33 to form the face of reservoir 31, a bellows system can be used having a rigid face with expansion and contraction of the reservoir space taking place by means of flexible side walls in the form of a bellows. As with the diaphragm, the bellows can be made of metal, e.g., stainless steel. Also, rather than using hydraulic valve assembly 35 to apply pressure to diaphragm 33, a pneumatic pressure source operatively interlinked with a trip switch for the pump's motor can be used. Similarly, a hydraulic pressure source operatively interlinked with a remote trip switch can be used rather than the direct action system shown in FIGS. 2–6. The direct action hydraulic system of FIGS. 2–6, however, is preferred since it provides the most direct shut off of the motor.

A variety of other modifications which do not depart from the scope and spirit of the invention will be evident to persons of ordinary skill in the art from the disclosure herein. The following claims are intended to cover the specific embodiments set forth herein as well as such modifications, variations, and equivalents.

What is claimed is:

1. A progressive cavity pump comprising:

(a) a stator;

(b) a rotor within the stator;

(c) drive means for rotating the rotor;

(d) a motor for rotating the drive means;

(e) temperature responsive means carried by the rotor for detecting the rotor's temperature at the temperature responsive means; and (f) control means associated with the temperature responsive means for stopping the rotation of the rotor when the detected rotor temperature at the temperature responsive means exceeds a predetermined value.

2. The progressive cavity pump of claim 1 wherein the temperature responsive means comprises a material which melts at the predetermined temperature.

3. The progressive cavity pump of claim 1 wherein the control means comprises a pressurized liquid and the temperature responsive means causes a change in the pressure of the liquid.

4. The progressive cavity pump of claim 3 wherein the temperature responsive means comprises a material which melts at the predetermined temperature, said melting causing a reduction in the pressure of the liquid.

5. The progressive cavity pump of claim 1 wherein the motor is a hydraulic motor powered by pressurized hydraulic fluid and the control means comprises means for causing the pressurized hydraulic fluid to bypass the motor.

6. The progressive cavity pump of claim 1 wherein:

the control means comprises a liquid-filled path which begins at the rotor and passes through at least a portion of the drive means, said liquid being at a predetermined pressure; and the temperature responsive means comprises a material which melts at the predetermined temperature, said melting causing a reduction in the pressure of the liquid.

7. The progressive cavity pump of claim 6 wherein the pump has a suction chamber, the liquid-filled path communicates with the suction chamber when the material melts, and the predetermined pressure is greater than the head pressure in the suction chamber under a deadhead condition.

8. The progressive cavity pump of claim 6 further comprising a vacuum chamber which is sealed by the material and which communicates with the liquid-filled path when the material melts.

9. The progressive cavity pump of claim 6 wherein the drive means comprises at least one shaft and the liquid-filled path comprises a channel formed in said at least one shaft.

10. The progressive cavity pump of claim 6 wherein the drive means comprises at least one sealed joint and the liquid-filled path comprises a sealed region of said at least one sealed joint.

11. The progressive cavity pump of claim 10 wherein the liquid comprises a joint lubricant.

12. The progressive cavity pump of claim 10 wherein the pump has a suction chamber, the sealed region of said at least one sealed joint communicates with the suction chamber upon failure of the seal, and the predetermined pressure is greater than the head pressure in the suction chamber under a deadhead condition.

13. The progressive cavity pump of claim 6 wherein the liquid-filled path comprises a reservoir and the control means comprises means for sensing the quantity of liquid within the reservoir.

14. The progressive cavity pump of claim 13 wherein the motor is a hydraulic motor powered by pressurized hydraulic fluid and the control means comprises a shaft which contacts the reservoir and moves in response to a decrease in the quantity of liquid within the reservoir so as to cause the pressurized hydraulic fluid to bypass the motor.

15. The progressive cavity pump of claim 14 wherein, when the material has not melted, the shaft transfers pressure from the pressurized hydraulic fluid to the liquid within the reservoir, said pressure being substantially equal to the predetermined pressure.

16. The progressive cavity pump of claim 14 wherein the reservoir comprises a diaphragm and the shaft contacts the diaphragm.

17. A progressive cavity pump comprising:

(a) a stator;

(b) a rotor within the stator;

(c) drive means for rotating the rotor;

(d) a motor for rotating the drive means;

(e) control means for controlling the motor;

(f) temperature responsive means carried by the rotor for detecting the rotor's temperature at the temperature responsive means; and (g) means for providing hydraulic communication between the temperature responsive means and the control means so that the motor stops rotating the drive means when the detected rotor temperature at the temperature responsive means exceeds a predetermined value.

18. A progressive cavity pump comprising:

(a) a stator;

(b) a rotor within the stator;

(c) drive means for rotating the rotor, said drive means comprising at least one joint which is lubricated by a lubricant which is a fluid;

(d) retaining means for retaining the lubricant within the joint, said retaining means defining a sealed region of the joint;

(e) a motor for rotating the drive means; and (f) monitoring means for continuously monitoring the integrity of the retaining means during operation of the pump.

19. The progressive cavity pump of claim 18 wherein the monitoring means controls the operation of the pump so that the motor stops rotating the drive means when a disruption in the integrity of the retaining means is detected by the monitoring means.

20. The progressive cavity pump of claim 18 wherein the monitoring means comprises a lubricant-filled path which includes the sealed region of the joint, said lubricant being at a predetermined pressure within the path, and wherein a disruption in the integrity of the retaining means causes a reduction in the pressure of the lubricant.

21. The progressive cavity pump of claim 20 wherein the pump has a suction chamber, the sealed region of the joint communicates with the suction chamber upon a disruption in the integrity of the retaining means, and the predetermined pressure is greater than the head pressure in the suction chamber under a deadhead condition.

22. The progressive cavity pump of claim 20 wherein the drive means comprises at least one shaft and the lubricant-filled path comprises a channel formed in said at least one shaft.

23. The progressive cavity pump of claim 20 wherein the lubricant-filled path comprises a reservoir and the monitoring means comprises means for sensing the quantity of lubricant within the reservoir.

24. The progressive cavity pump of claim 23 wherein the motor is a hydraulic motor powered by pressurized hydraulic fluid and the monitoring means controls the operation of the motor and comprises a shaft which contacts the reservoir and moves in response to a decrease in the quantity of lubricant within the reservoir so as to cause the pressurized hydraulic fluid to bypass the motor.

25. The progressive cavity pump of claim 24 wherein the shaft transfers pressure from the pressurized hydraulic fluid to the lubricant within the reservoir, said pressure being substantially equal to the predetermined pressure.

26. The progressive cavity pump of claim 25 wherein the reservoir comprises a diaphragm and the shaft contacts the diaphragm.

27. A method for controlling a progressive cavity pump, said pump comprising a stator, a rotor within the stator, and means for rotating the rotor, said method comprising:

(a) providing temperature sensing means for sensing the temperature of the pump's rotor, said means being carried by the rotor and generating a signal when the temperature of the rotor at the sensing means exceeds a predetermined temperature; and (b) applying the signal to the means for rotating the rotor to stop said rotation when the temperature of the rotor at the temperature sensing means exceeds the predetermined temperature.

28. A method for controlling a progressive cavity pump, said pump comprising a stator, a rotor within the stator, and rotating means for rotating the rotor, said rotating means including at least one joint which is lubricated by a lubricant fluid, said method comprising:

(a) pressurizing the lubricant fluid;

(b) detecting a drop in the pressure of the lubricant fluid; and (c) stopping the rotation of the pump's rotor in response to the detected drop in pressure.

* * * * *